US007603810B2

(12) United States Patent
Marocco

(10) Patent No.: US 7,603,810 B2
(45) Date of Patent: Oct. 20, 2009

(54) PLUG IN PULL BAR HINGE

(76) Inventor: Mario M Marocco, 240 Bartor Road, Toronto, Ontario (CA) M9M 2W6

( * ) Notice: Subject to any disclaimer, the term of this patent is extended or adjusted under 35 U.S.C. 154(b) by 0 days.

(21) Appl. No.: 11/984,863

(22) Filed: Nov. 21, 2007

(65) Prior Publication Data

US 2009/0126277 A1 May 21, 2009

(51) Int. Cl.
*E06B 7/086* (2006.01)

(52) U.S. Cl. ..... 49/87.1

(58) Field of Classification Search ..... 49/74.1, 49/87.1

See application file for complete search history.

(56) References Cited

U.S. PATENT DOCUMENTS 5,187,896 A * 2/1993 Ross ..... 49/74.1
5,303,507 A * 4/1994 Oille ..... 49/74.1
5,548,925 A 8/1996 Marocco
5,778,598 A 7/1998 Ohanesian
6,041,547 A 3/2000 Marocco
6,250,012 B1 * 6/2001 Ricci ..... 49/87.1
6,418,665 B1 * 7/2002 Gabriele ..... 49/87.1
7,377,074 B2 * 5/2008 Marocco ..... 49/87.1
2004/0025438 A1 * 2/2004 Marocco ..... 49/87.1

* cited by examiner

*Primary Examiner*—Jerry Redman

(57) ABSTRACT

A shutter having a frame, and having louvres rotatably supported in the frame, and a control bar, for controlling the louvres, and having two-component connectors connecting respective louvres to the control bar, consisting of a louvre hinge member for attachment to a louvre and a control bar hinge member for, and having a louvre hinge body, a louvre plug integral with the louvre hinge body for insertion into a louvre, a concave surface on said louvre hinge body engaging said louvre which prevents twisting, a hinge opening, and having a control bar hinge body, a control bar plug, a control bar hinge pin, cooperating with said hinge opening in said louvre hinge body to provide a hinging action.

2 Claims, 4 Drawing Sheets

PLUG IN PULL BAR HINGE

FIELD OF THE INVENTION

The invention relates to shutters of the type having a frame, and louvres rotatable in the frame, and a control bar connected to the louvres, for rotating them open and closed, and having connectors connecting the control bar to the louvres

BACKGROUND OF THE INVENTION

Shutters for windows and doors usually have a frame, hinged to the window or door opening, and rotatable louvres extending across the frame, from side to side. A control bar is connected to the louvres. Moving the control bar rotates all the louvres. In this way the louvres can be tilted open for light and air, or tilted up or down and closed for privacy.

Shutters have been made in this general pattern for hundreds of years. Usually they were made of wood. The control bar was connected to the louvres, in earlier designs, by a pair of wire staples, one secured to the control bar and the other secured to the louvre.

This was primitive, and tended to become disengaged, over time. It is desirable to provide a shutter with louvres and a control bar and an improved connector connecting the control bar to each of the louvres. This connector should provide a secure attachment to both the control bar, and also to each of the louvres. The connector must have a hinging action to permit tilting of the louvres, up or down, as the control bar is moved. The connector should also be such that is easy to assemble and install.

Various different connector devices have been used in the past. In one system, shown in U.S. Pat. No. 5,778,598, Ohanessian, the connectors were attached to a stick. The stick was then installed in a control bar. This imposed limits on the spacing between louvres. The spacing of the louvres depends one the actual size of the window opening. This may vary. To adjust for this the shutters may have to be made with custom specific louvre spacings.

This in turn requires custom specific spacings of the connectors on the control bar. This was not possible where the spacings between the connectors on the control bar were already predetermined.

An improved system is shown in U.S. Pat. No. 5,548,925 N Marocco, Aug. 27 1996. In this system the connectors are separate from the control bar. A somewhat related system is shown in U.S. Pat. No. 6,041,547 N Marocco Mar. 28 2000.

It is desirable to provide a connector member which is simple to attach to each louvre, and to the control bar, with a minimum of hand labour and training.

However the connector should also be of strong durable construction, and have an aesthetic appearance, to complement the entire design of the product and enhance its overall appearance.

BRIEF SUMMARY OF THE INVENTION

With a view to providing shutter with a frame and having louvres and a control bar and connector members which satisfies these objectives the invention provides a shutter with a frame and louvres, and a control bar, for controlling the louvres, and two-component connectors connecting the louvres to the control bar, in which the two component connector is formed with a louvre hinge member, for attachment to the louvre, and a control bar hinge member for attachment to the control bar and the louvre hinge member comprising a louvre plug for insertion into the louvre, a louvre hinge body integral with the louvre plug, a semi arcuate convex abutment portion on the body which engages a portion of the louvre, an louvre hinge opening in the body defining a hinge axis normal to the louvre plug member, and the control bar hinge member comprising control bar plug for insertion into the control bar, a control bar hinge pin integral with the control bar plug for insertion into said louvre hinge opening, and a rim on the hinge pin, and retention members in the louvre hinge opening for retaining the control bar hinge part.

Preferably the control bar hinge member has a body, an L-shaped member on the body, and said control bar plug extends from said body, for insertion into the control bar, and said control bar hinge pin extends from said L-shaped member normal to the plug.

Preferably the body and the L-shaped member are both of square shape, and said control bar hinge pin defines a head at its free end, a shoulder adjacent to said L-shaped member, and a reduced neck between said head and said shoulder. Preferably within the hinge opening, the louvre hinge body defines interior flexible flanges interengageable with the reduced neck on the control bar hinge pin. Preferably the concave surface defines an axis which is parallel to but spaced from the hinge opening axis, and prevents the louvre hinge member from twisting. Usefully, the louvres will be formed in section with a generally aerofoil shape and defining a hollow interior, with openings formed in said louvres for receiving said louvre hinge members.

Usefully the control bar will be formed of plastic, as a hollow extrusion, with a channel defining an opening mouth, and an attachment wall for receiving the control bar hinge members.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
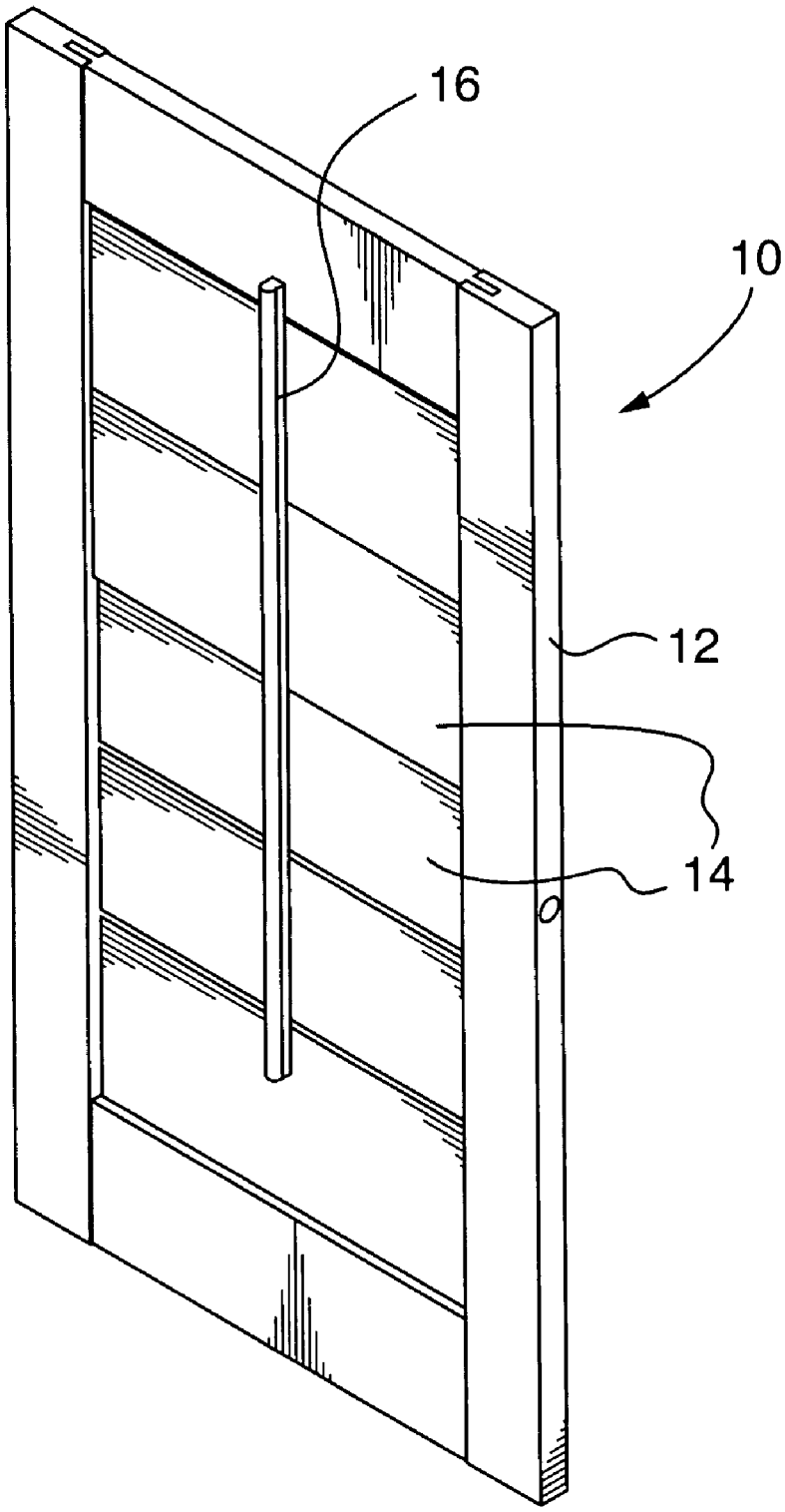
FIG. 1 is a perspective illustration of a shutter, with louvres, and with a control bar and connectors illustrating the invention.

As already described in general, a shutter (10) consists of a rectangular frame (12), with sides and a top and bottom, louvres (14) rotatably located between the two sides of the frame, and a control bar (16), FIG. 1. Typically the shutter will be hung by hinges (not shown) in a window or a door opening. As such the general construction, and the location and use of shutters is well known.

The frame (10) may be of any suitable material, synthetic or natural.

Figure 2:
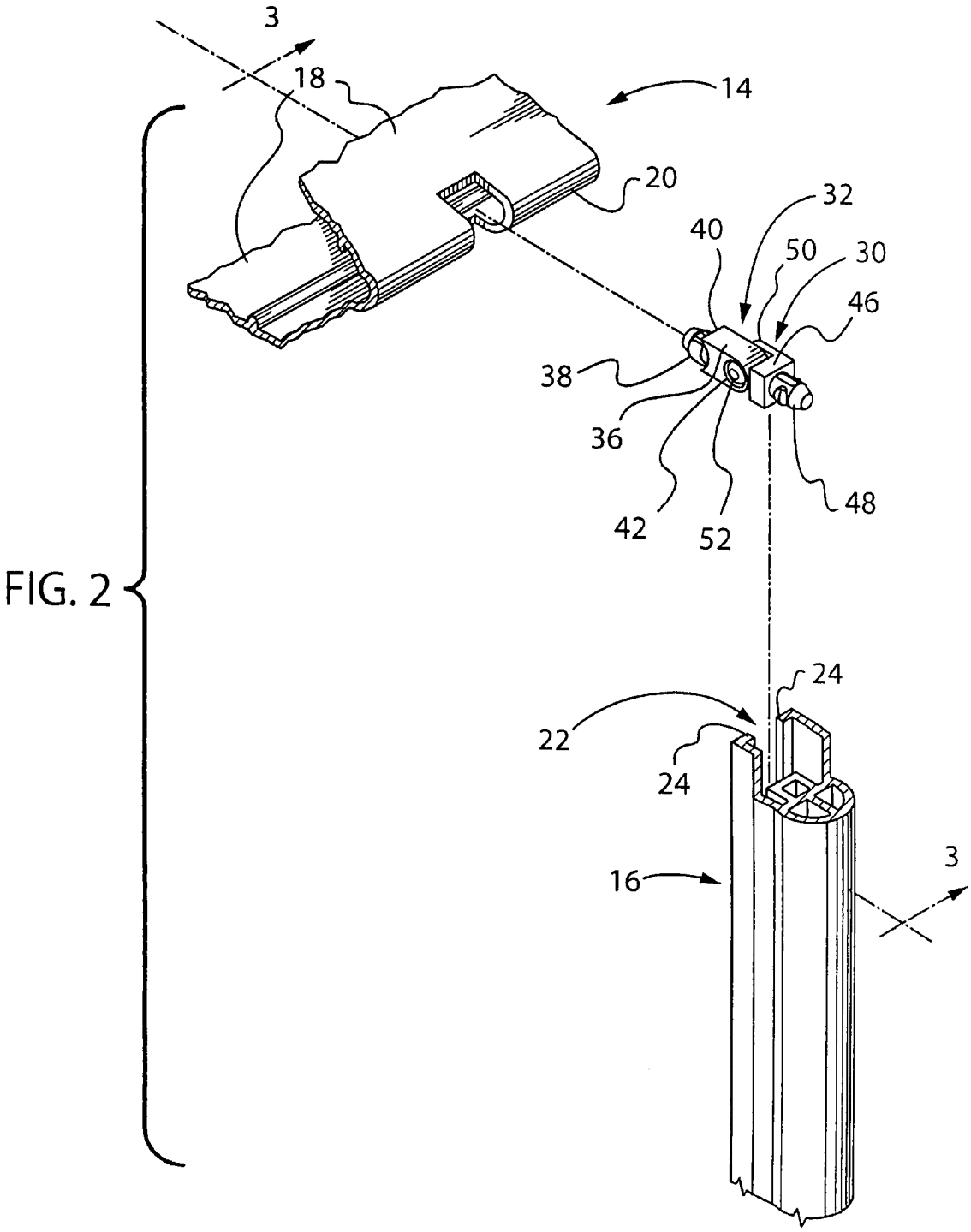
FIG. 2 is an exploded perspective illustration of the control bar and a louvre and a connector shown in isolation, with the louvre partially cut away.
Figure 3:
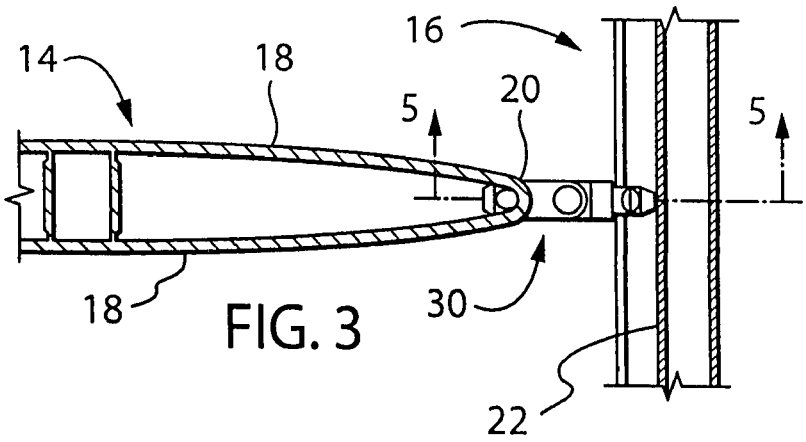
FIG. 3 is a section along 3-3 of FIG. 2.
Figure 4:
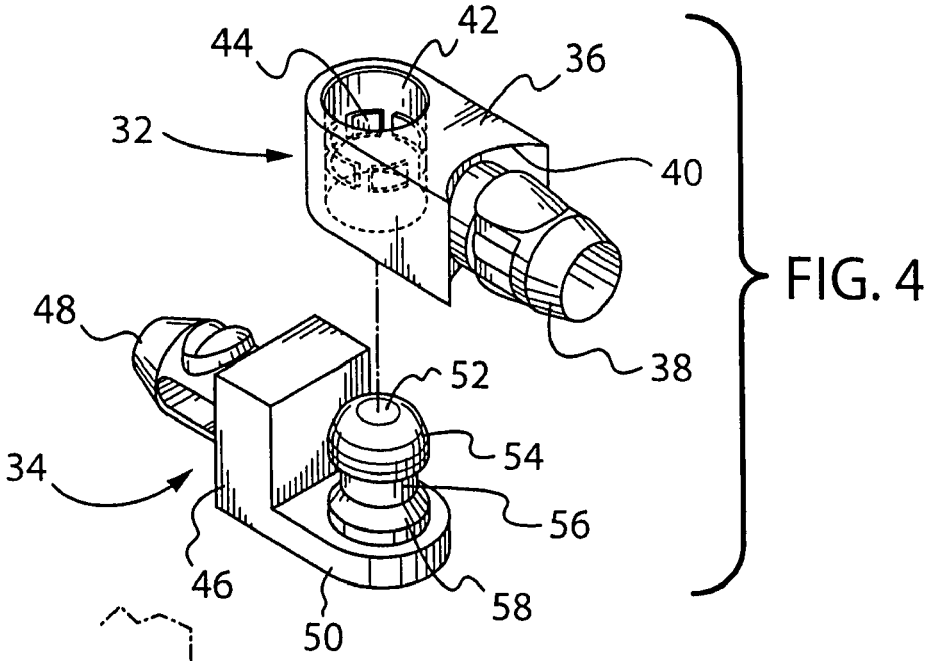
FIG. 4 is a an exploded perspective of a connector.

In accordance with one embodiment of the present invention, as illustrated the louvres are of extruded plastic construction and define a hollow interior, FIG. 2.

However the invention does not exclude shutters with louvres made of other materials, which may be natural or synthetic.

In this description, as illustrated the louvres (14) in this form of construction define a generally aerofoil shape in section, with upper and lower blade walls (18) of generally convex shape, meeting along edges (20). A hollow interior is not critical. The louvres can also be solid.

At each end each louvre is provided with a pivot not shown which fits in a receiving recess (not shown) in the side members of the frame (10).

The louvres (14) can be rotated between open and closed position, to either admit light or exclude it. This also provides privacy. To open and close the louvres all together, and maintain them all in a uniform position, a control bar (16) is provided.

Control bar (16) in this embodiment as illustrated, is also formed of extruded plastic hollow construction. However the invention does not exclude shutters with a control bar made of other materials, which may be natural or synthetic.

A hollow interior is not critical. The control bar can also be solid. Control bar (16) in this form of construction defines a channel (22) with side walls (24) and a convex web, and having a mounting wall (26) across the interior of channel (22). Mounting wall (26) is recessed within the side walls (24) of channel (22) and thus defines a shallow recess for reasons to be described.

Openings (28) are formed in mounting wall (26) at spaced intervals for reasons to be described.

Figure 5:
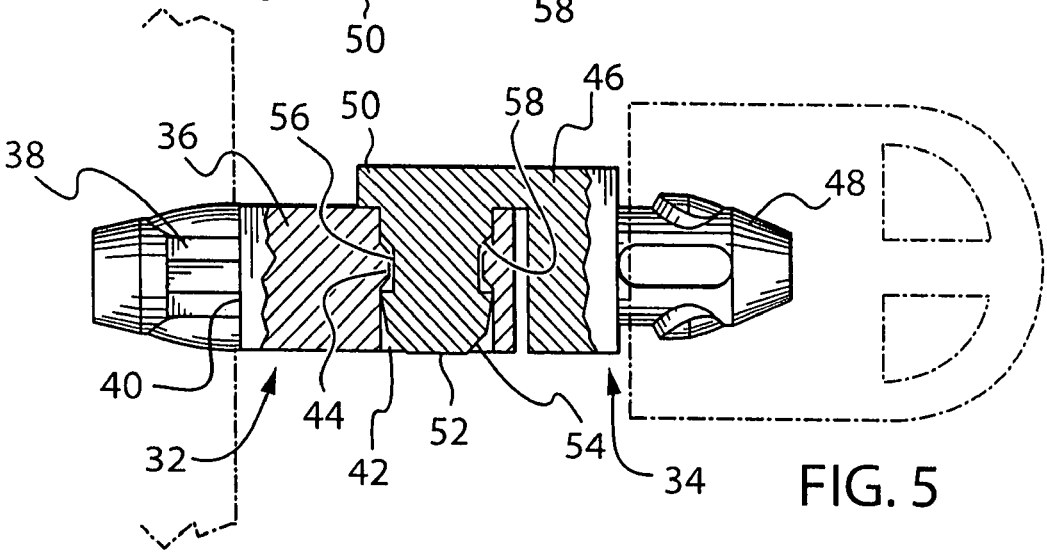
FIG. 5 is a side elevation of a connector.

In order to connect the several louvres (14) to the control bar (16), connectors (30) are provided, FIGS. 2, to 5.

Each connector (30) consists of two components namely a louvre hinge member (32) and a control bar hinge member (34) which connect as described below and provide a hinge action between them.

The louvre hinge member (32) has a body (36). A louvre plug (38) extends from the body for insertion into a louvre. Body (36) defines a concave surface (40) which conforms to the curvature of the louvre edge. Concave surface (40) cooperates to prevent twisting of the body (36). Body (36) further defines a louvre hinge opening (42). Opening (42) defines a hinge axis normal to the axis of plug (38), and parallel to the edge of the louvre (14).

The axis of the concave surface (40) and the axis of the hinge opening (42) are spaced apart but parallel to each other.

Within the interior of opening (42) there are formed inwardly extending flanges (44). The flanges (44) are of flexible or at least somewhat resilient construction, and are divided from each other for reasons to be described below.

The control bar hinge member (34) has a body (46). A control bar plug (48) extends from body (46) for insertion into the openings formed in wall (26) of the control bar (16).

Body (46) defines an L-shaped member (50), extending normal to body (46). Body (46) is of square shape and fits within the shallow recess defined by the side walls of channel (22) and the mounting wall (26). This assists in preventing twisting of the control bar hinge member (34). A control bar hinge pin (52) extends normal to L-shaped member (50) and normal to the axis of control bar plug (48). Control bar hinge pin (52) is spaced apart from body (46) to define a space for louvre hinge body (36), as described below.

Hinge pin (52) is formed with a head (54), at its free end, a reduced neck (56) and a shoulder (58) adjacent to L-shaped member (50).

In use after insertion of the louvre plug into the louvre, and the control bar plug into the control bar, the control bar hinge pin (52) may be inserted into the louvre hinge opening (42) in the louvre hinge member (32).

The flanges (44) within opening (42) will flex or expand and then fit around the neck (56) on control bar hinge pin (52).

The same operations can be repeated until all the louvres are coupled to the control bar (16).

Figure 6:
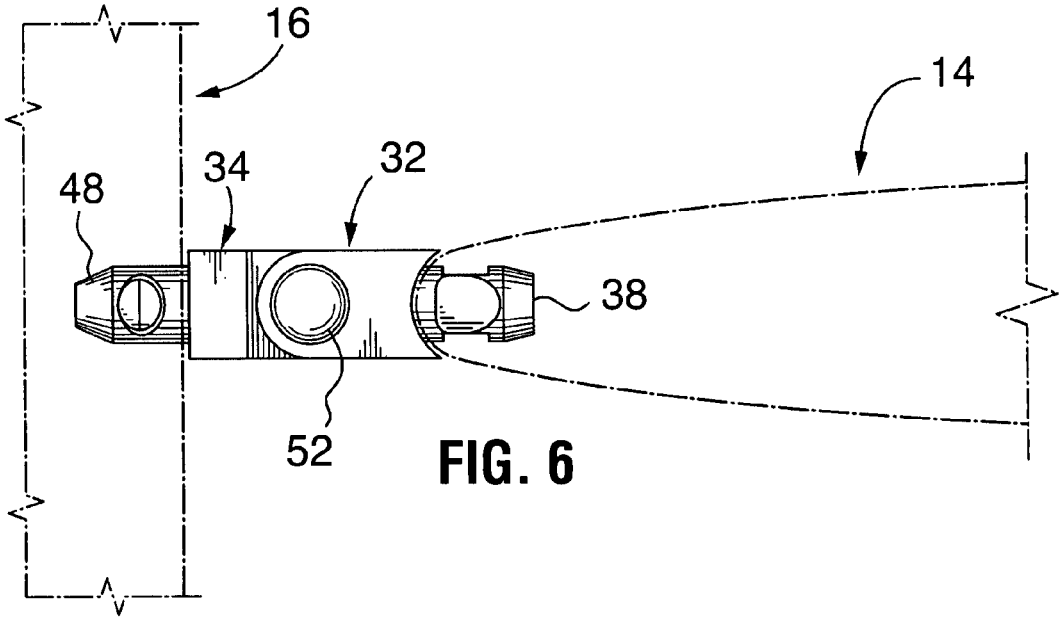
FIG. 6 is a side elevation showing the plug in hinge in a first position; and, FIG. 7 is a side elevation corresponding to FIG. 6 showing the plug in hinge in a second position.
Figure 7:
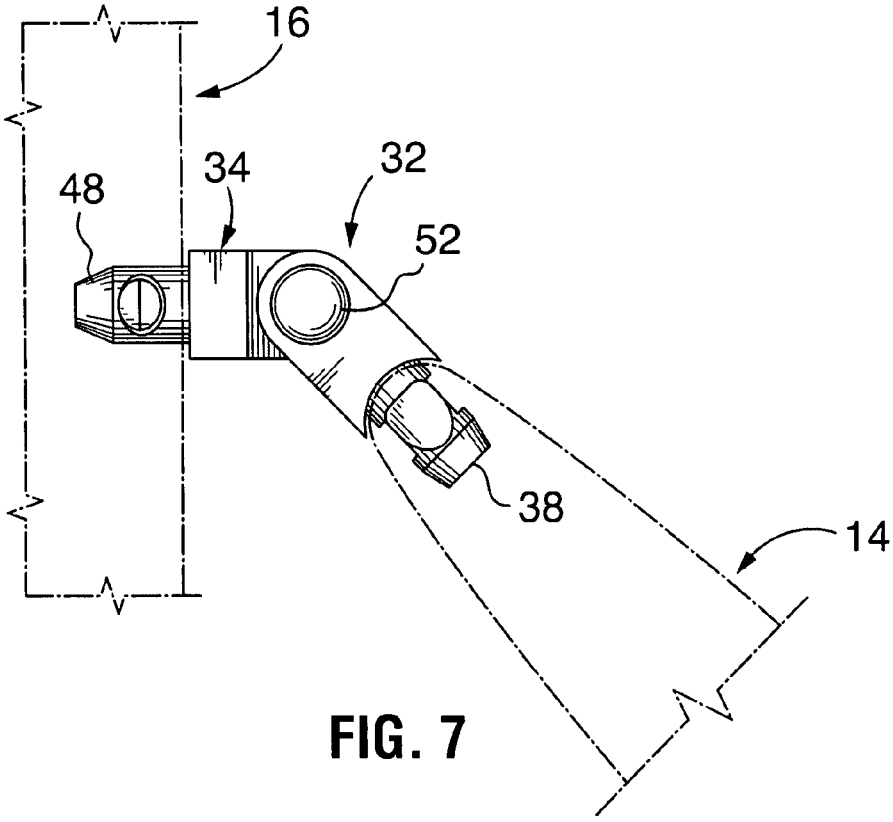

Movement of the control bar (16) will then cause all louvres to move together. As the control bar is moved the control bar hinge pins will move and rotate relative to louvre hinge openings (42), and provide a hinging action, compare FIG. 6 with FIG. 7. The concave surface (40) engaging the louvre prevents twisting of the louvre connector.

The rectangular body (46) received within the side walls (24) of control bar (16) prevents twisting of the control bar hinge member (34).

In this way the hinge pin and hinge openings are always kept in alignment with each other to provide a smooth hinge rotation.

The plugs on both the louvre hinge member and on the control bar hinge member can be given exterior abutments or formations, suitable for whatever material is used for making the louvres and the control bar respectively.

The spacing between the control bar hinge pin and the control bar body allows space for reception of the louvre hinge body, when the two components are assembled together.

It will be seen that in this way the two part connectors provide the hinging action required. The two components i.e. the louvre hinge member and the control bar hinge member remain fixed in their respective louvres and control bar and do not move. The louvres and the control bar can be of many different materials, and can be made solid if desired.

For example, the control bar, (and also the louvres) can be made of wood. In this case the control bar would have drillings, at spaced intervals, to receive the plugs 48. Drillings would also be made in the louvres.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a frame, and having louvres rotatably supported in the frame, and a control bar, for controlling the louvres, and having two-component connectors connecting respective louvres to the control bar, each said connector consisting of a louvre hinge member for attachment to a respective said louvre and a control bar hinge member for attachment to the control bar and wherein said each said louvre hinge member comprises:

a louvre hinge body;

a louvre plug integral with the louvre hinge body for insertion into a respective said louvre a concave surface on said louvre hinge body engaging said respective louvre which prevents twisting of said louvre hinge member relative to said respective louvre;

a hinge opening in said louvre hinge body along an axis normal to said louvre plug member, said hinge opening being formed with flexible flanges within said hinge opening;

and wherein said control bar hinge member comprises;

a control bar hinge body of rectangular shape and including an L-shaped portion of rectangular shape, extending from said control bar hinge body;

a control bar plug integral with said control bar hinge body and dimensioned to engage said control bar and prevent twisting;

a control bar hinge pin on said control bar hinge body, extending normal to the axis of said control bar plug, and cooperating with said hinge opening in said louvre hinge body to provide a hinging action and said flexible flanges within said hinge opening, being engageable with said hinge pin and said hinge pin being formed with a head at its free end, a shoulder adjacent said control bar hinge member and a reduced neck between the head and the shoulder to receive said flexible flanges;

and wherein said control bar comprises;

side walls, a convex web joining said side walls, and a mounting wall extending between said side walls and with said side walls defining a shallow recess, and wherein said rectangular shape of said control bar hinge body is dimensioned to inter fit within said side walls in said shallow recess to prevent twisting.

2. A shutter as claimed in claim 1 and wherein said control bar hinge pin is located on said L-shaped portion, spaced apart from said control bar hinge body and providing space for reception of said louvre hinge body.

* * * * *